US005538234A

United States Patent [19]

Yankloski

[11] Patent Number: 5,538,234

[45] Date of Patent: Jul. 23, 1996

[54] AUTOMATIC MAILING MACHINE

[75] Inventor: Richard Yankloski, Webster, N.Y.

[73] Assignee: Data Pac Mailing Systems Corp., Webster, N.Y.

[21] Appl. No.: 294,122

[22] Filed: Aug. 22, 1994

Related U.S. Application Data

[63] Continuation-in-part of Ser. No. 42,372, Apr. 2, 1993, Pat. No. 5,340,097.

[51] Int. Cl.[6] ..... B65H 5/08

[52] U.S. Cl. ..... 271/11; 271/185; 271/225; 209/900; 198/463.3

[58] Field of Search ..... 271/2, 4, 5, 10.01, 271/11, 149, 150, 104, 105, 107, 184, 185, 225, 273; 209/2, 525, 583, 584, 592, 593, 900; 198/463.3, 606, 607

[56] References Cited

U.S. PATENT DOCUMENTS

| | | | |
|---|---|---|---|
| 2,998,355 | 6/1961 | Rabinow | 271/150 X |
| 3,365,699 | 1/1968 | Foster | 209/525 X |
| 3,782,541 | 1/1974 | Wood | 209/74 |
| 3,893,392 | 7/1975 | Brenn | 271/5 X |
| 4,488,610 | 12/1984 | Yankloski | 177/4 |
| 4,516,209 | 5/1985 | Scribner | 364/466 |
| 4,688,678 | 8/1987 | Zuc et al. | 209/552 |
| 4,778,062 | 10/1988 | Iauic | 209/584 X |
| 4,893,249 | 1/1990 | Silverberg | 364/464.03 |
| 4,923,022 | 5/1990 | Hsieh | 177/4 |
| 4,973,037 | 11/1990 | Holbrook | 271/2 |
| 5,147,048 | 9/1992 | Signoretto | 209/698 |
| 5,163,669 | 11/1992 | Hurd et al. | 271/125 |
| 5,174,454 | 12/1992 | Parkander | 209/583 X |
| 5,191,196 | 3/1993 | Mercede | 235/484 |
| 5,340,097 | 8/1994 | Yankloski | 271/11 X |

FOREIGN PATENT DOCUMENTS

| | | | |
|---|---|---|---|
| 2097767 | 11/1982 | United Kingdom | 271/11 |

*Primary Examiner*—William E. Terrell
*Assistant Examiner*—Tuan Nguyen
*Attorney, Agent, or Firm*—M. Lukacher

[57] ABSTRACT

An automatic mailing machine includes a mail transport device for moving individual pieces of mail, which can be of varying shapes and sizes, from a mail bundle to an oppositely disposed apparatus for weighing such pieces of mail and to then move same to a further station for additional processing. The automatic mailing machine may include apparatus for detecting the size of the piece of mail being processed and weighed which then compares that information against a norm. The automatic mailing machine is configurable to occupy a much smaller space than conventional mailing machines.

6 Claims, 10 Drawing Sheets

AUTOMATIC MAILING MACHINE

The present application is a continuation-in-part of my application Ser. No. 08/042,372 filed Apr. 2, 1993, which issued Aug. 23, 1994 as U.S. Pat. No. 5,340,097.

BACKGROUND OF THE INVENTION

The present invention relates to a mailing apparatus, and particularly to a mailing machine which automatically discerns letters of varying size, weighs the letters individually, applies appropriate bar codes, if desired, to each letter and then transfers each letter to either a bulk mailing station or to a further station where each letter is dispensed automatically to a receptacle designated for the particular zip code previously applied to the letter, and especially which can be configured to occupy little space so as to provide a compact mailing machine.

In the past, machines such as the above have been rather large and occupy a substantial amount of floor space, or, if the individual mailing functions have not been combined into one apparatus, the individual pieces will be remotely located from each other making the procedure of processing mail less efficient, more time consuming and, accordingly, more costly to process mail.

Examples of previously known mail processing devices, or similar devices are shown in U.S. Pat. No. 3,782,541 entitled "Apparatus for Transferring Stacks of Mail or Like Articles", issued Jan. 1, 1974; U.S. Pat. No. 4,488,610 entitled "Sorting Apparatus", issued Dec. 18, 1984; U.S. Pat. No. 4,516,209 entitled "Postage Metering System Having Weight Checking Capacity", issued May 7, 1985; U.S. Pat. No. 4,688,678 entitled "Sorter Apparatus for Transporting Articles to Releasing Locations" issued Aug. 25, 1987; U.S. Pat. No. 4,893,249 entitled "Mailing Machine", issued May 8, 1990; U.S. Pat. No. 4,923,022 entitled "Automatic Mailing Apparatus" issued May 8, 1990; U.S. Pat. No. 5,147,048 entitled "Sorting Line for Processing Envelopes, Particularly for Photographic Laboratories", issued Sep. 15, 1992; U.S. Pat. No. 5,163,669 entitled "Paper Feed Mechanism Having an Adjustable Restrainer", issued Nov. 17, 1992; U.S. Pat. No. 4,973,037 entitled "Front End Feeder for Mail Handling Machine", issued Nov. 27, 1990 and U.S. Pat. No. 5,191,196 entitled "Apparatus for Adjustably Securing a Bar Code Scanner Device Using Nylon Hook and Loop Type Fasteners" issued Mar. 2, 1993.

SUMMARY OF THE INVENTION

The present invention is therefore directed toward a mailing machine which occupies a minimal amount of floor space and which automatically processes mail for bulk mailings, or handles individual mail pieces of varying sizes and weights and which may be utilized to apply appropriate bar codes to individual pieces of mail and to then sort and direct those pieces of mail to appropriate zip code stations.

Briefly, in accordance with one feature of the present invention, a mailing machine is provided having a first station for holding letters, which may be of varying size and weight; a second station for receiving a single letter from the first station and, if required, weighing such letter; a third station for applying a bar code to the letter, should such be required, and then propelling the letter to a fourth station where the letter is transferred to either a bulk mailing machine or to a zip code sorting apparatus.

The mailing machine may include a further station for collecting each piece of mail and then automatically transporting it to an appropriate storage space designated for the zip code applied to the letter.

The mailing machine may further include apparatus in communication with the zip code sorting and storing apparatus for determining when a storage space for any zip code is full.

A further embodiment of the mailing apparatus provides a system which permits loading pieces of mail directly onto the weigh scale, weighing said individual piece of mail and then immediately and automatically transporting said mail piece on to a further station where the appropriate postage is applied. This further embodiment of the mailing apparatus provides a device which also is capable of handling mail pieces which are of varying sizes without providing any manual adjustments to the apparatus whatsoever. Further, this embodiment also includes apparatus which automatically senses mail pieces which are oversized and automatically calculates an appropriate penalty price which is then automatically factored into the cost of postage for that piece of mail.

DETAILED DESCRIPTION OF THE PREFERRED EMBODIMENT

1) Relationship of Parts

Figure 1:
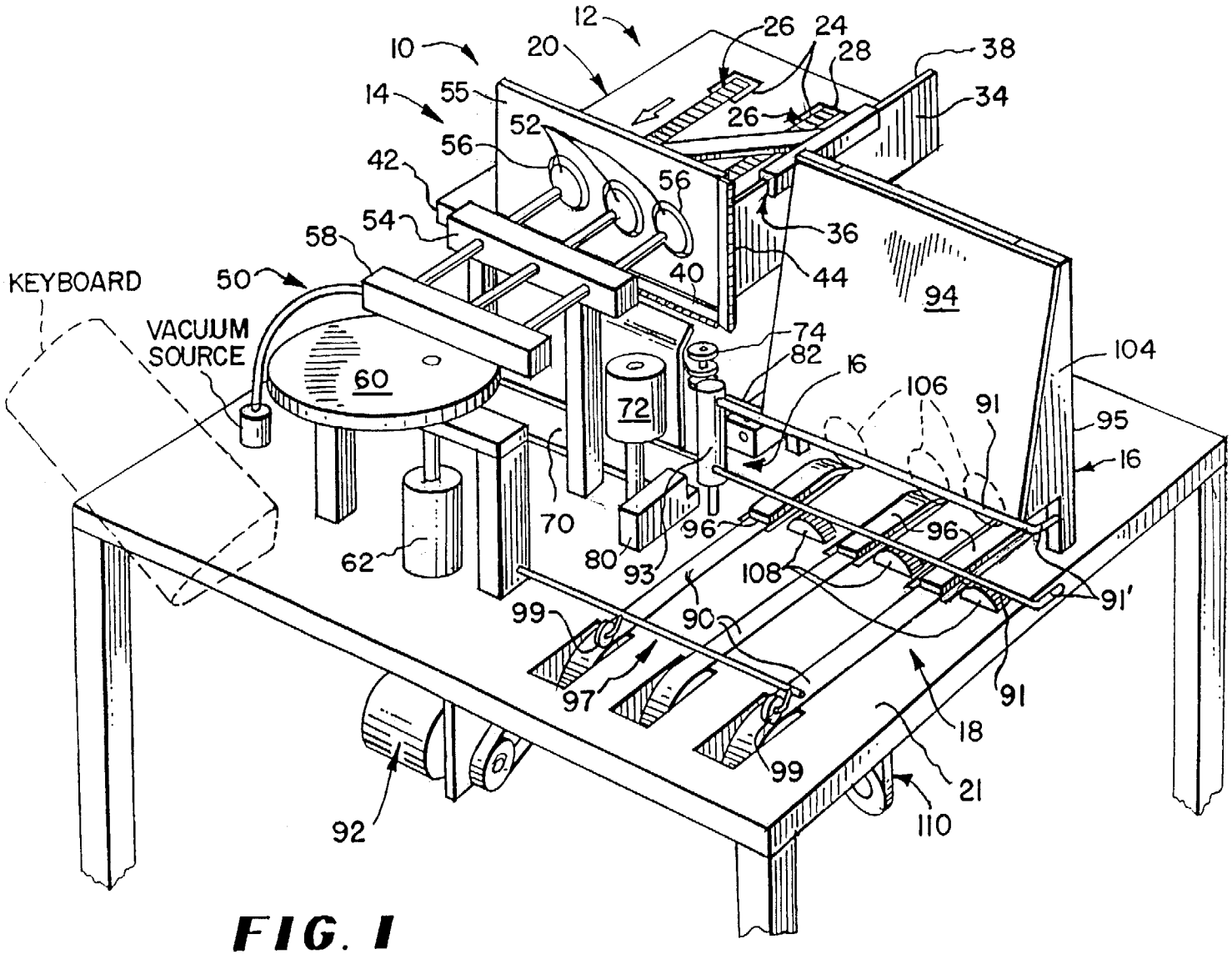
FIG. 1 is a perspective view of the automatic mailing machine according to the present invention.

As illustrated in FIG. 1, the automatic mailing machine 10 of the present invention generally includes 1) a first letter stacking and transport station 12 for receiving and supporting a stack of letters which may be of various sizes and weights; 2) a second station 14 for transferring an individual letter from the first station to a weighing machine; 3) a third station 16 for applying designated bar codes to each individual piece of mail (should such be desired) and for ejecting them thereafter to a 4) fourth station 18 for directing each piece of mail to either a bulk mailing machine or to a zip code sorting apparatus.

Figure 2:
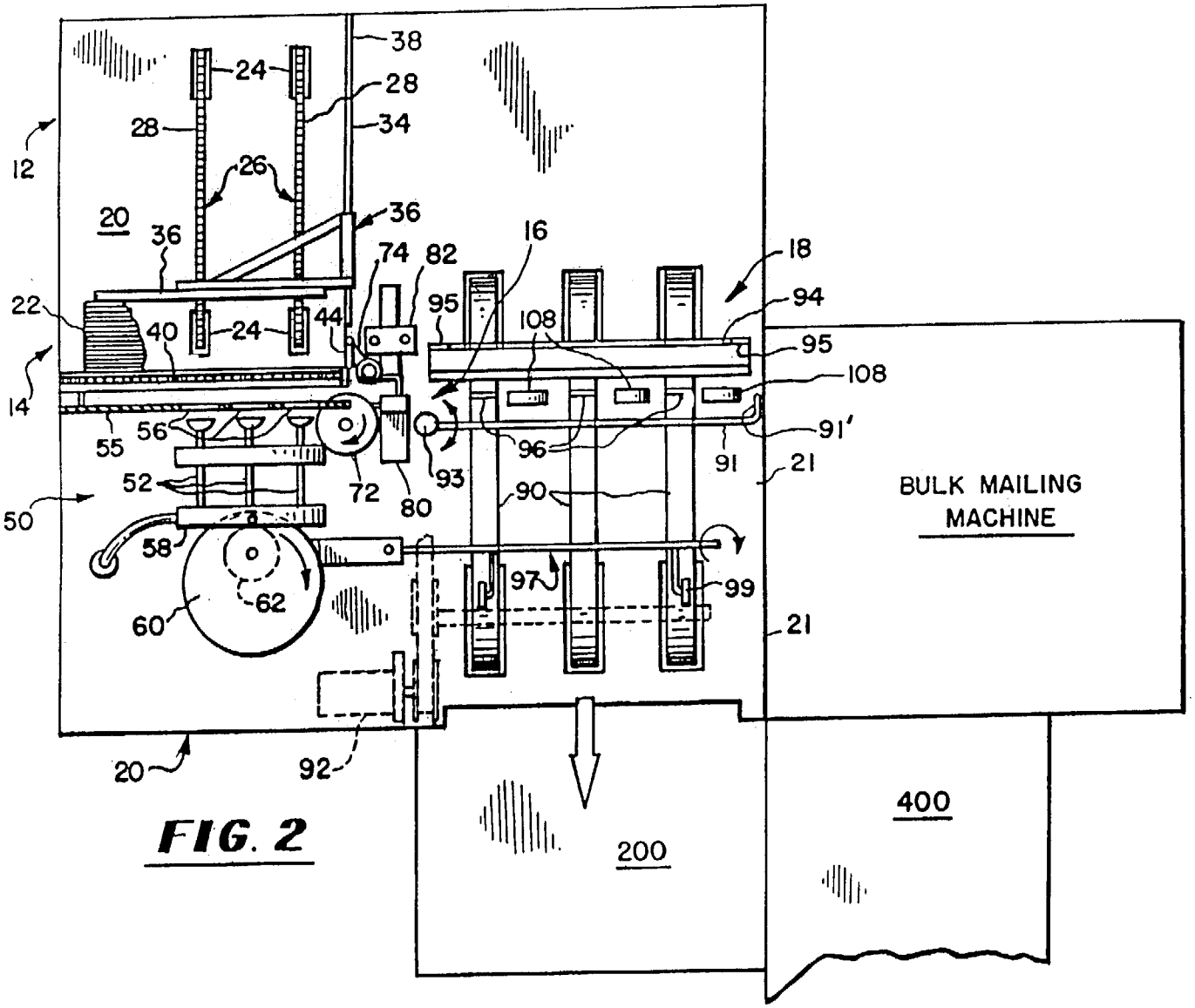
FIG. 2 is a top plan view of the automatic mailing machine shown in FIG. 1.
Figure 3:
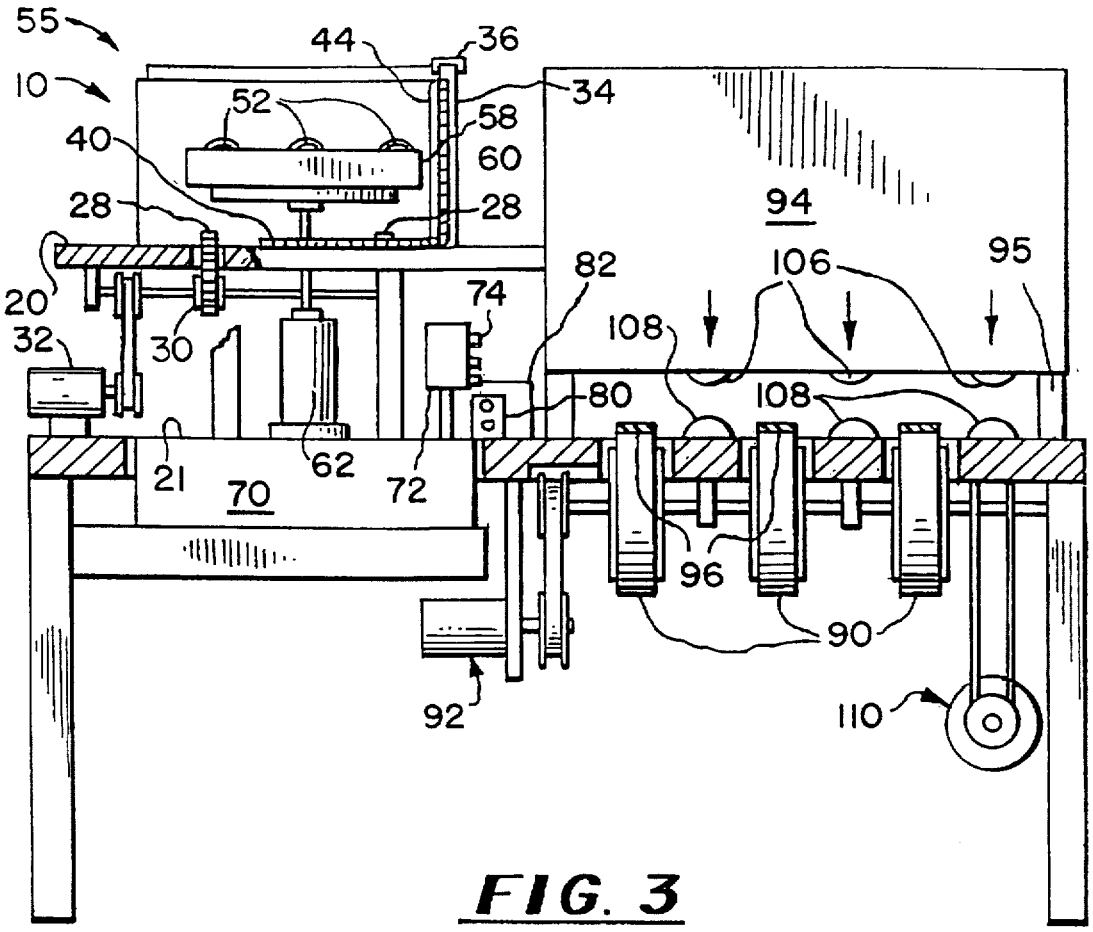
FIG. 3 is a front view thereof.

The first letter stacking and transport station 12 comprises a table 20 on which a stack of letters 22, as best illustrated in FIG. 2, is disposed. The table 20 has a plurality of slots 24 formed therein so as to be generally perpendicular to the stack of letters 22. A chain and sprocket assembly 26 is disposed in each of the slots so that the chain 28 is elevated slightly above the table 20. The sprocket 30 is connected to an appropriate drive motor 32, as seen in FIG. 3, which is energized to cause rotation of the sprockets and, therefore, translation of the drive chains 28 along surface of the table 20.

A guide rail 34 is mounted perpendicularly to the table 20 generally adjacent the edge of the stack of letters 22. A pressure plate 36 is slidably mounted to the guide rail 34 along the rail's top edge 38 while the bottom of the bar is received and supported by the plurality of chains such that movement of the chains imparts a likewise movement of the pressure plate 36. The pressure plate 36 which is driven by the chains, exerts a constant and even pressure against the stack of letters 22 toward a horizontal plate 40 which is pivotably mounted generally toward the front edge 42 of table 20 and against which the first letter in the letter stack 22 bears. A further plate 44 is pivotally mounted vertically to the table 20 in juxtaposition to horizontal plate 40 and adjacent the edge of the letter stack 22.

A vacuum pickup mechanism 50 is mounted to table 20 and comprises a plurality of suction devices 52 supported above the table by way of support fixture 54 for horizontal reciprocating movement toward and away from a horizontal plate 55 which is fixed in position just forward of the hinged plates 40 and 44. Plate 55 includes a series of apertures 56 equal to the number of suction devices 52 and in alignment therewith. Each of the suction devices 52 is secured at the end opposite the suction end to a vacuum manifold 58 which, in turn, is pivotally affixed to a cam member 60 rotatably driven by way of motor 62.

A weigh scale 70 is mounted to table 20 adjacent and generally below the letter stack 22. A rotatable letter transport wheel 72 is mounted to the table 20 immediately adjacent the weigh scale 70. A pivoting kicker wheel 74 is also mounted to table 20 so as to be in close relationship to transport wheel 72.

A bar code print head 80 and bar code pressure plate 82 are disposed on table 20 so as to be immediately adjacent the letter transport wheel 72 and the kicker wheel 74. The bar code pressure plate 82 is movable toward and away from the print head 80.

Figure 4:
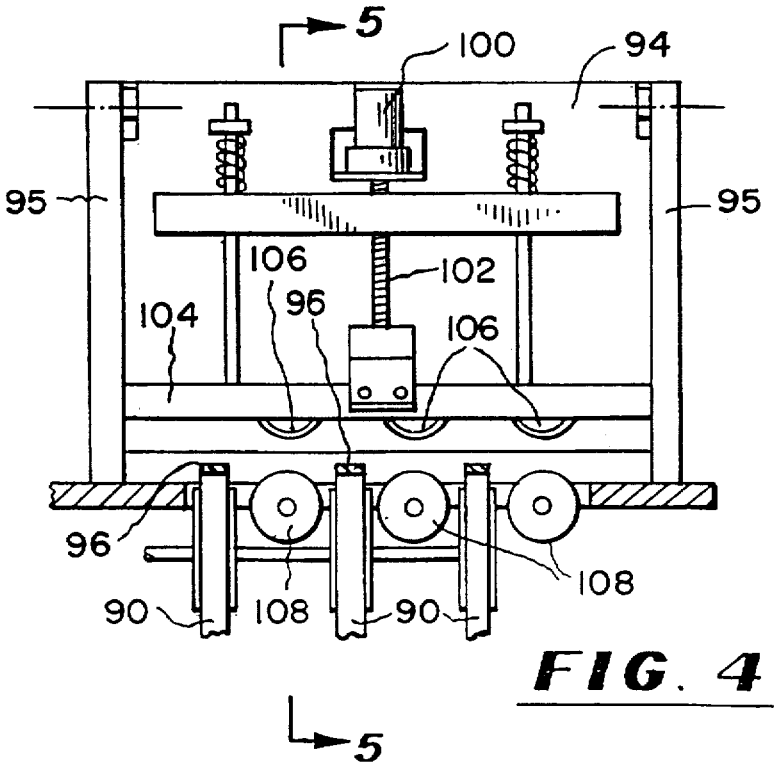
FIG. 4 is a rear view of the support and letter transfer bar.
Figure 5:
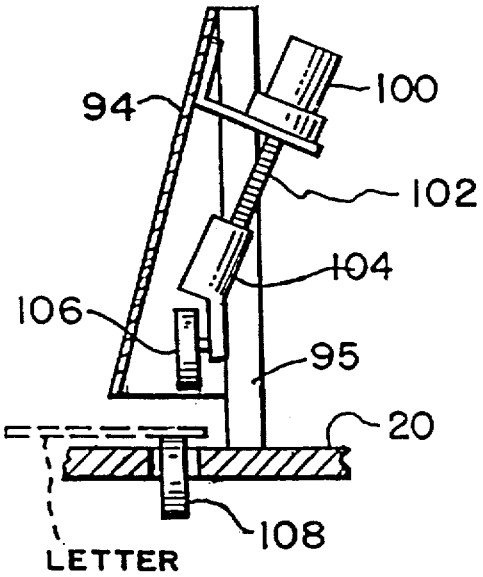
FIG. 5 is a sectional view taken along line 5—5 of FIG. 4 showing the roller wheels of support and letter transfer bar; in a retracted position.
Figure 6:
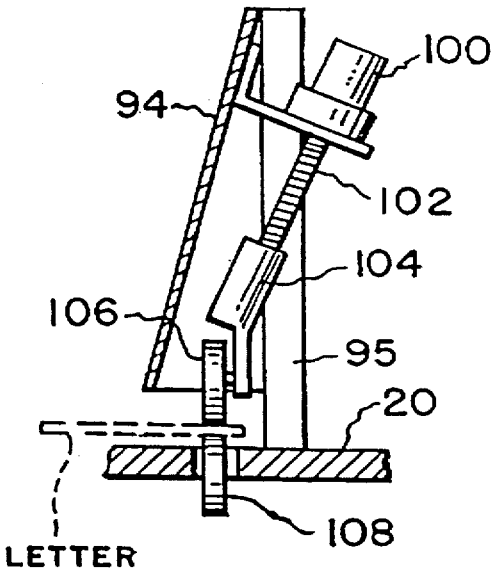
FIG. 6 shows the roller wheels of FIG. 4 in position directly over a letter supported by the transport belts.

A plurality of transport belts 90 are affixed to an appropriate pulley/motor assembly 92 so as to protrude through table 20 in a direction generally parallel to that of the chain and sprocket assembly 26. A plate 94 is vertically mounted to the table 20 by vertical mounts 95 so as to straddle the transport belts 90 and to be generally opposite the weigh scale 70, kicker wheel 74, bar code print head 80, etc. A motor 100, as best seen in FIG. 4, is secured to the plate 94 and includes a lead screw 102 coupled to an angular member 104 to which a series of rollers 106 is mounted. The lead screw 102 is threadably received by plate 94 such that rotation of the screw 102 causes the member 104 to translate therealong as best seen in FIG. 3. A number of ejection wheels 108 are rotatably mounted to table 20 between the transport belts 90 and perpendicular thereto. The ejection wheels are coupled to an appropriate motor/pulley system 110, as best seen in FIG. 3.

Figure 7:
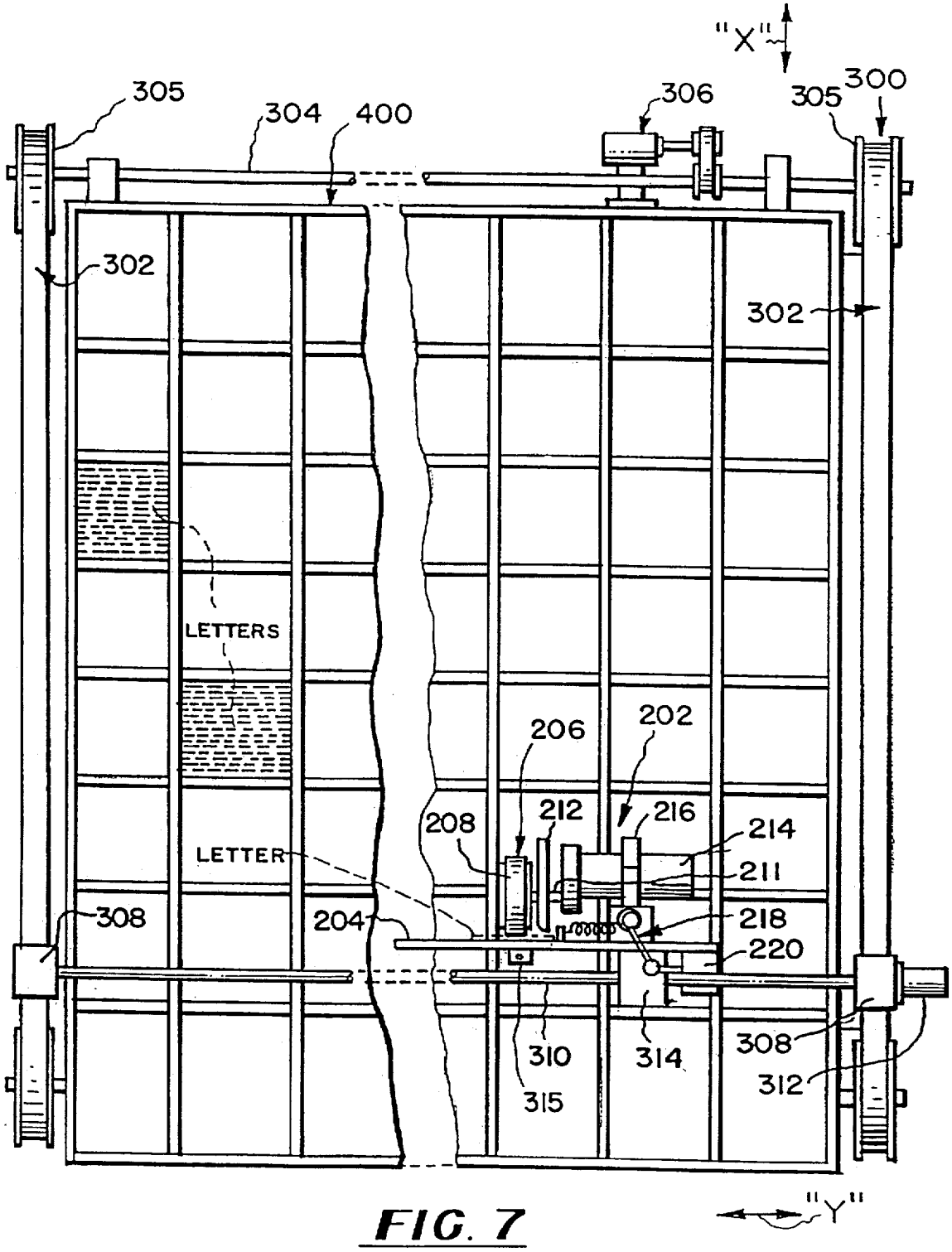
FIG. 7 is a front view of the zip code transport and storing apparatus.
Figure 10:
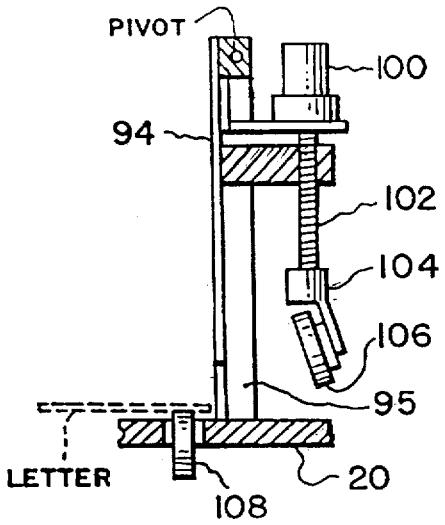
FIGS. 10 and 11 are variations of the apparatus shown in FIGS. 5 and 6.
Figure 11:
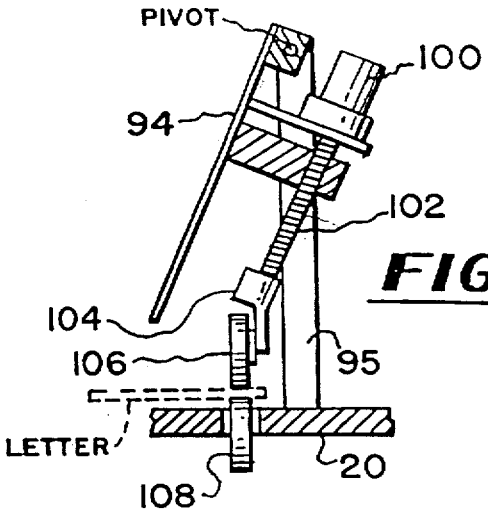
Figure 8:
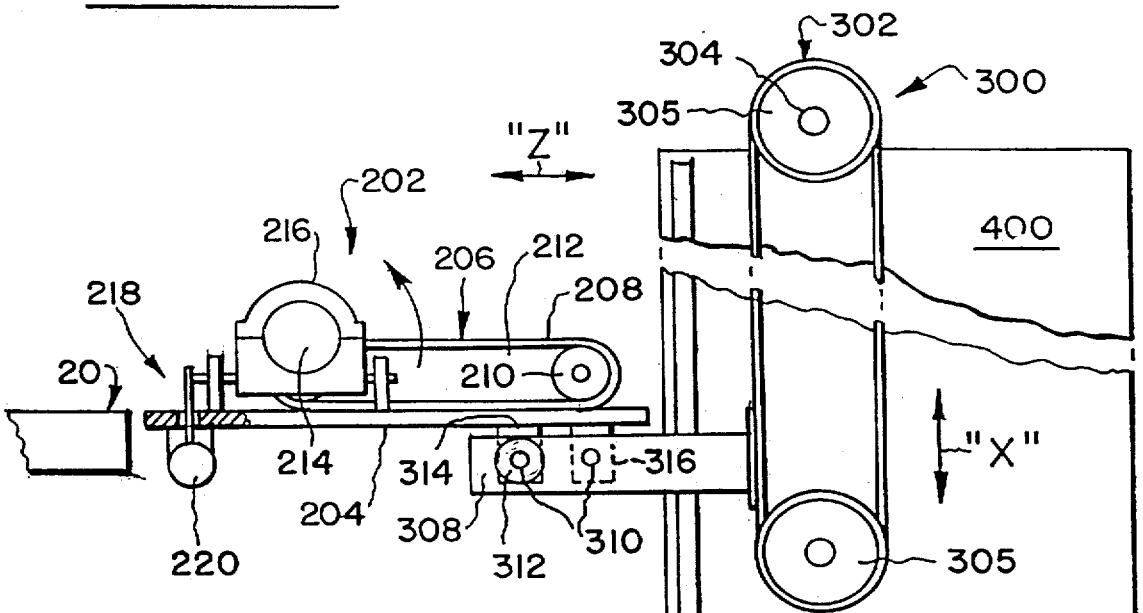
FIG. 8 is a side view of the apparatus shown in FIG. 7.
Figure 9:
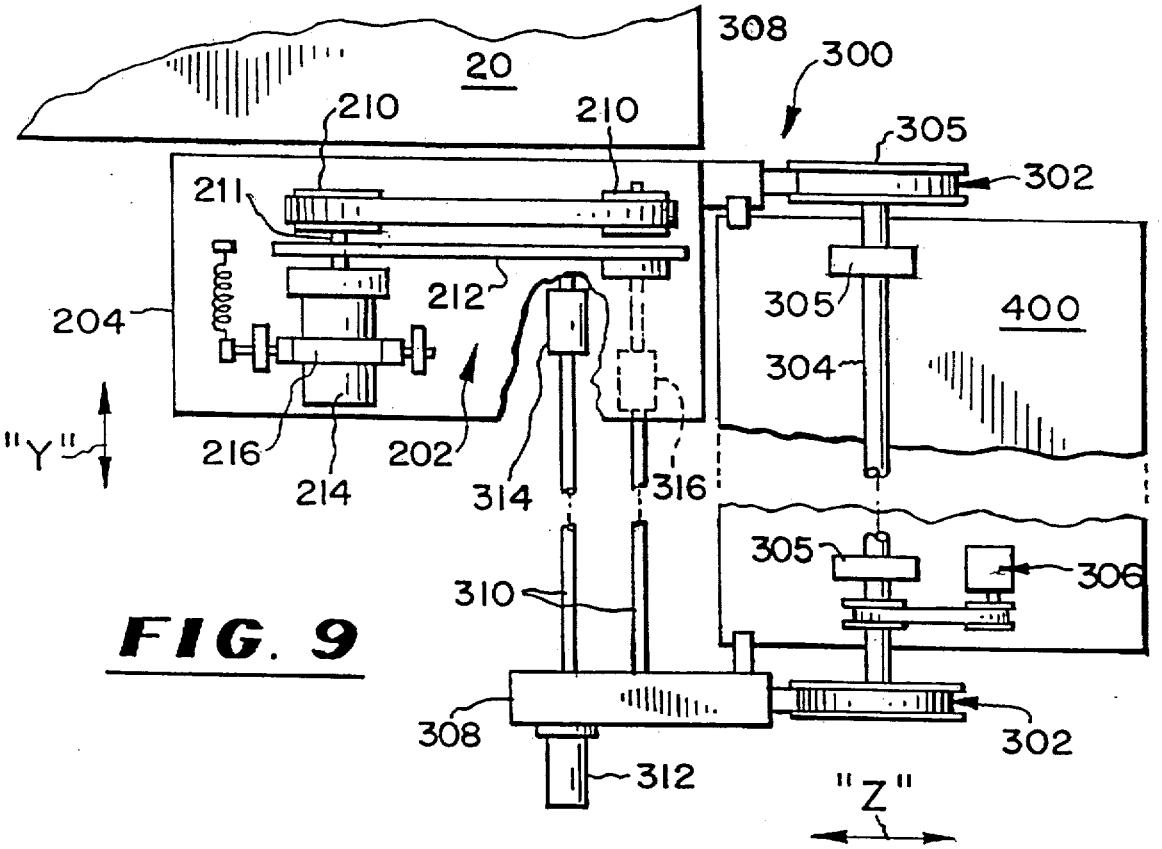
FIG. 9 is a top view of the apparatus shown in FIGS. 7 and 8.

As best illustrated in FIG. 2, an apparatus 200 for transporting and storing individual pieces of mail mounts to the front of the table 20 adjacent the transport belts 90 as further detailed in FIGS. 7–9; apparatus 200 includes a letter pickup assembly 202, a transport device 300 for shifting letters simultaneously in the X-, Y- and Z- directions and a storage rack 400 consisting of a plurality of storage cavities each of which corresponds to a specific zip code number.

Letter pickup assembly 202 includes a plate 204 mounted generally horizontal to table 20 and a motorized tractor belt assembly 206 which is mounted to plate 204 so as to be pivotable from a first position parallel to, and touching or nearly touching the surface of the plate to a second position away from the plate's surface. The tractor belt assembly 206 comprises a flexible drive belt 208 mounted between a complimentary pair of pulleys 210 which are rotatably secured to a vertical support 212 fixed to plate 204. One of the pulleys 210 is connected via a drive axle 211 to an appropriate motor 214 which is pivotally mounted to the plate 204 by yoke 216. A crank and pin mechanism 218, as best illustrated in FIG. 7, is activated by a solenoid 220 to cause the letter pickup assembly to pivot thereby rotating the tractor belt toward or away from the surface of plate 204.

As best depicted in FIGS. 7–9, transport device 300 includes a pair of pulley and belt assemblies 302 mounted to opposite sides of storage rack 400. A common axle 304 journalled to the top of storage rack 400 connects together the upper pairs of pulleys 305 of the pulley and belt assemblies 302. Axle 304 is rotated by any appropriate mechanism, such as by a pulley, belt and motor assembly 306. A support plate 308 is affixed to each belt of the pulley and belt assembly 302 so as to extend perpendicularly therefrom, as shown in FIG. 8. A pair of linear guide and transport rods 310 are mounted to and extend between the support plates 306 and are aligned with and parallel to each other. One of the rods is rotated by an electric motor 312 which is affixed to one of the support plates 308. The other rod is simply fixed therebetween. A linear clutch 314 is journalled to the rotatable rod 312 and secured to the bottom of plate 204. A bearing 316 is journalled about the fixed rod and is secured to the bottom of plate 204. As is best seen in FIGS. 7 and 8, the letter pickup assembly 202 mounts perpendicular and parallel to the front of storage rack 400.

Figure 12:
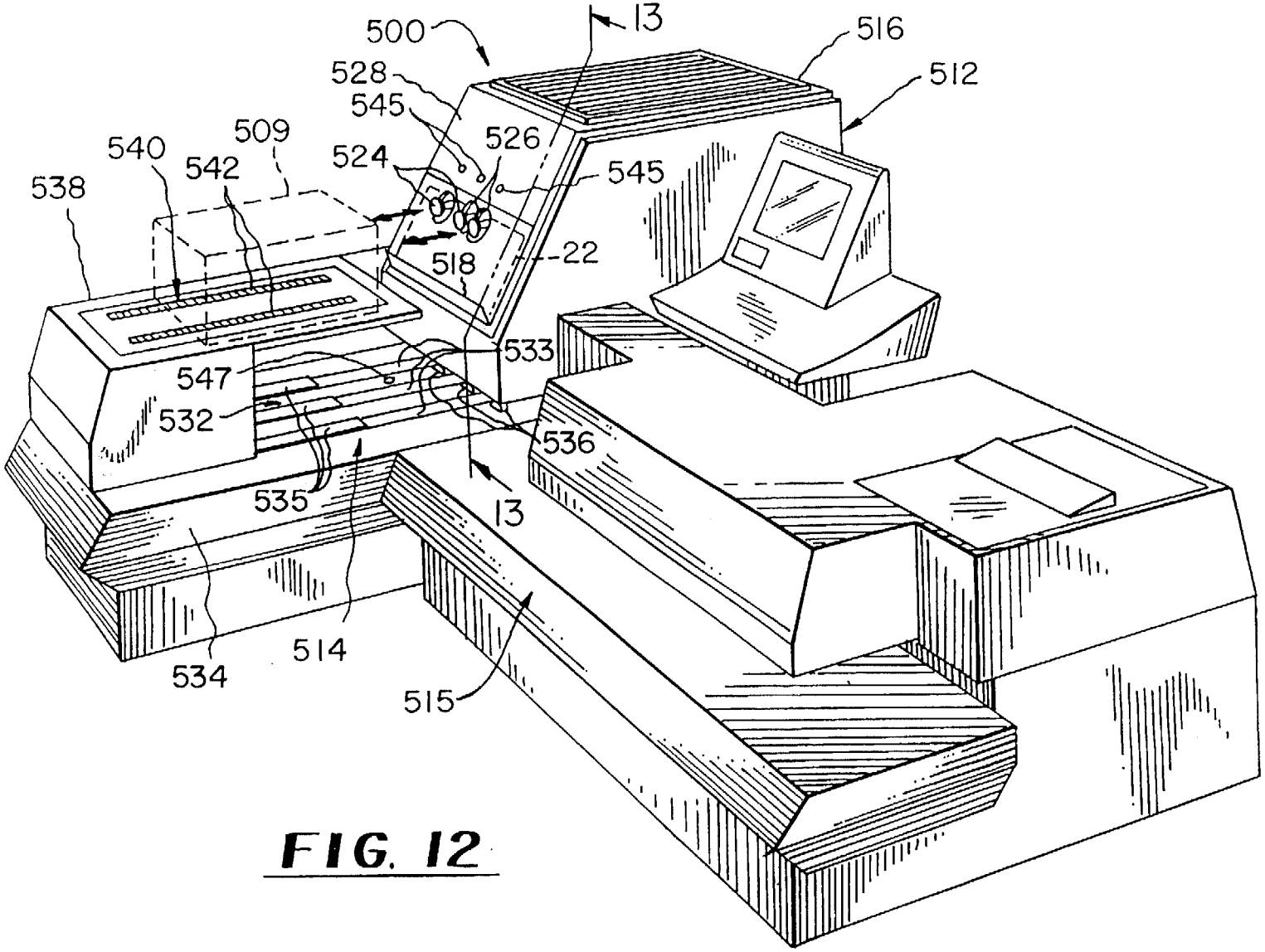
FIG. 12 is a perspective view of a further embodiment of the automatic mailing machine disclosed in FIGS. 1–11.
Figure 13:
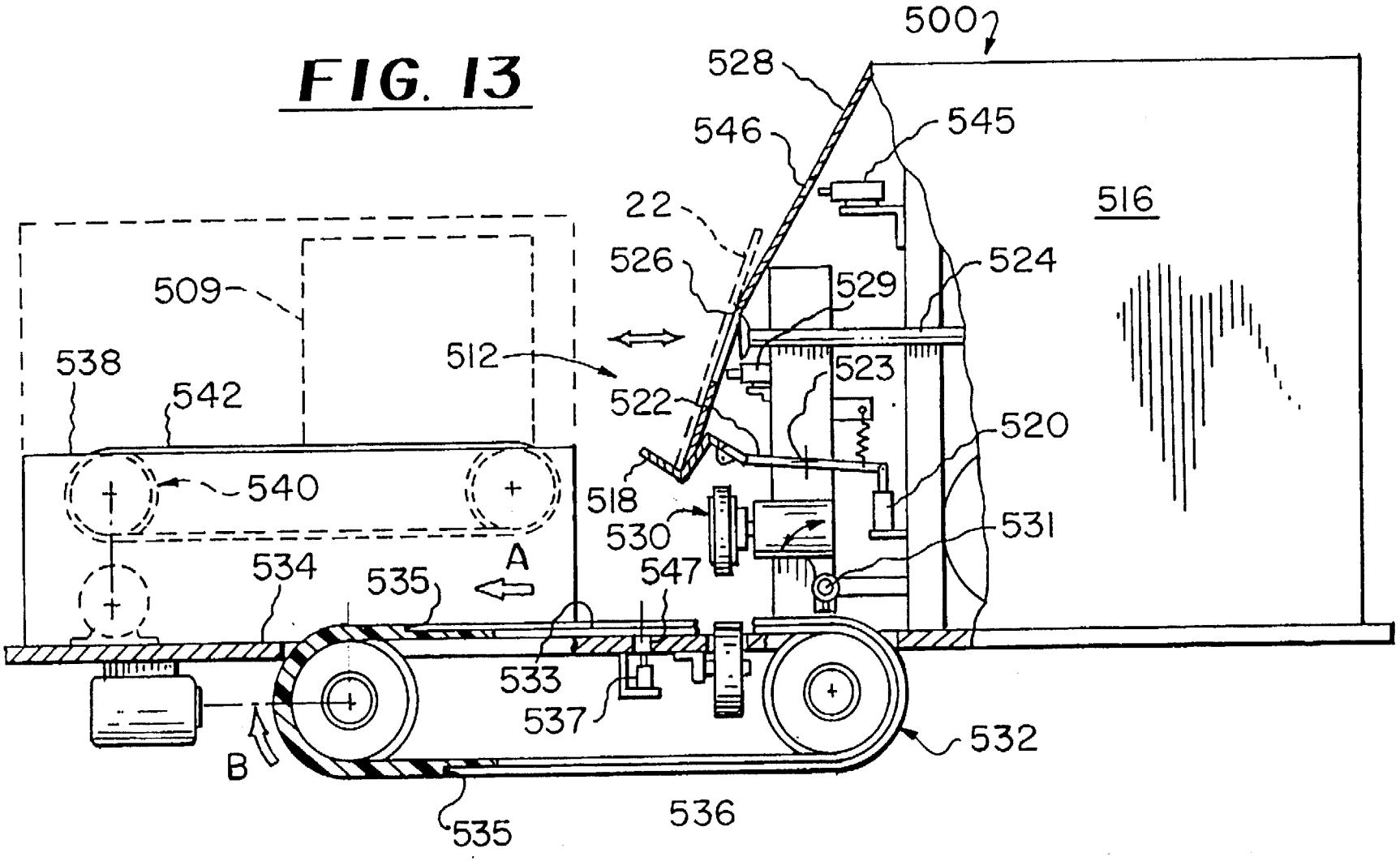
FIG. 13 is a simplified sectional view taken along line 13—13 of FIG. 12; and showing a letter in place on the weigh scale support.
Figure 14:
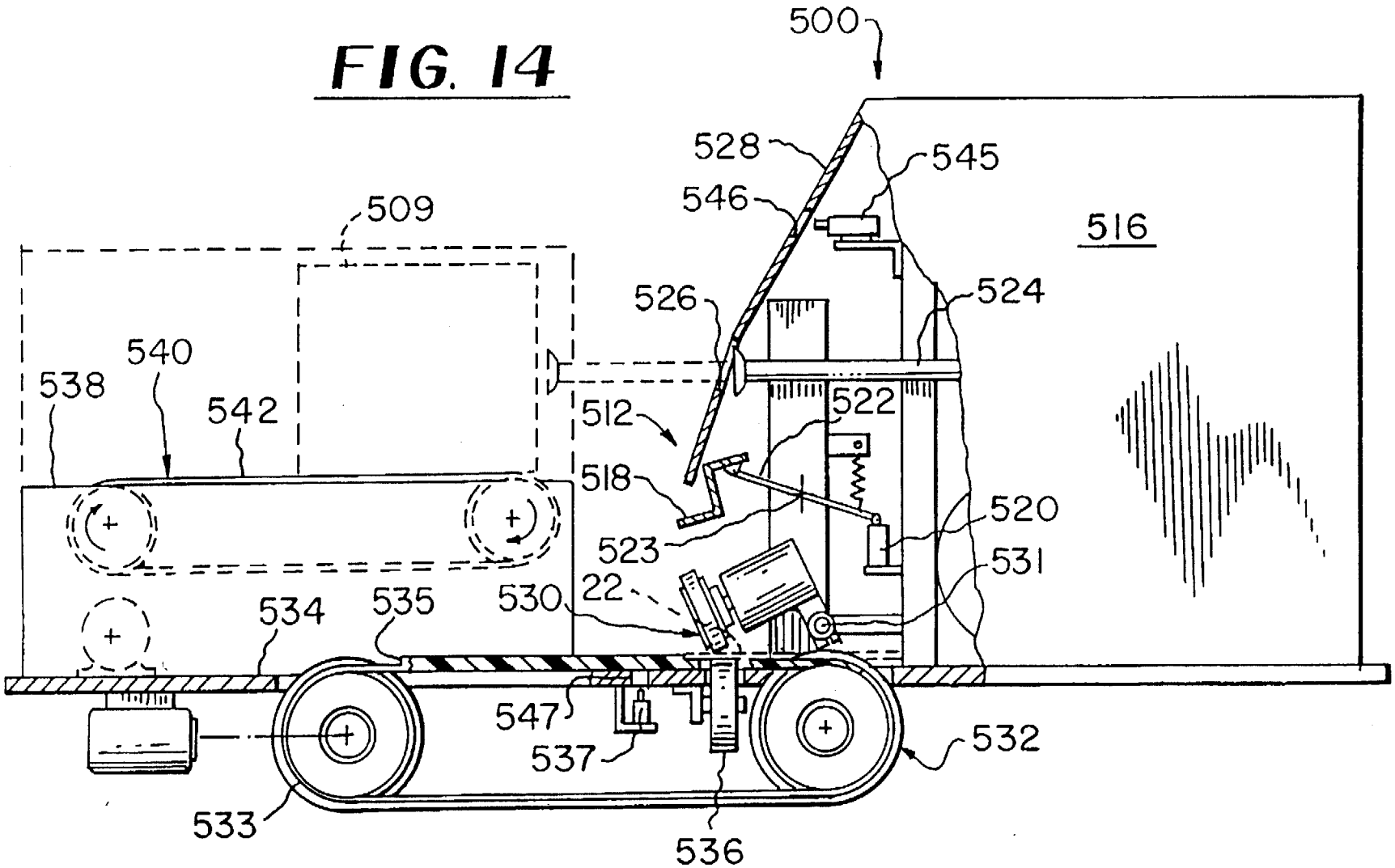
FIG. 14 is a view similar to FIG. 13 showing the weigh scale support in a retracted position and the letter deposited onto the transport belts and wheels.

A further embodiment of the invention is shown in FIGS. 12–14. Herein, an automatic mailing machine 500 includes a mail weighing station 512 for receiving and weighing individual pieces of mail, such as letters 22, which may be of varying sizes and shapes; and a mail transport station 514 for receiving mail from the mail weighing station and for transporting same to further mail handling apparatus 515, such as were explained hereinabove with respect to the embodiments shown and disclosed in FIGS. 1–11.

The mail weighing station 512 includes housing 516 which contains a pivoting letter support member 518 upon which individual pieces of mail, such as letters 22, are received. Pivoting support member 518, which may be in the form of an elongated platform, is coupled to an appropriate solenoid 520 by means of a spring loaded fulcrum lever 522. A plurality of suction devices 524 are horizontally disposed for reciprocating movement within housing 516 and through apertures 526 formed in front plate 528 thereof. A photo sensor 529 is located with respect to suction devices 524 so the light beams emitted therefrom strike and thereby detect the first letter in the mail bundle. A tractor belt drive assembly 530 is pivotably mounted within housing 516 so as to be generally perpendicular with respect to a complimenting set of transport pulley and belt assemblies 532 mounted to support table 534. A set of free floating pinch rollers 536 are appropriately mounted to table 534 to be generally aligned below pivoting tractor belt drive assembly 530. A letter support platform 538 is mounted to table 534 generally opposite mail weighing station 512. As in the previously described embodiment, the letter support platform 538 includes apparatus 540 (such as sprockets and chains) for supporting pieces of mail thereon and for transporting such mail therealong so that each piece of mail is engaged by the reciprocating suction devices 524 and thereafter moved onto the pivoting support plate 518 of weigh station 512.

2) Operation of the Apparatus

The following description sets forth the operation of the automatic mailing machine.

A mail bundle 22, which may comprise letters of different sizes, shapes and weights is stacked vertically upon table 20 between the pressure bar 36 and the hinged horizontal and vertical plates 40 and 44 respectively, as best seen in FIG. 2. Upon activation of the apparatus, the chain and sprocket assembly 26 begins rotating and the chains 28 which carry the mail stack 22 begin translating along the table's surface. The first letter of the letter stack 22 is forced by the movement of the chains 28 against the hinged horizontal and vertical plates 40 and 44, respectively. As sufficient force is exerted against the plates, they are caused to pivot to an "open" position and simultaneously, by use of a common switch (such as a micro switch, not shown here), the motor 62 of vacuum pickup mechanism 50 is energized which, in turn, rotates the cam 60. The suction devices 52 carried by cam 60 are translated toward the vertical plate 55 and through a series of apertures 56 formed therein to engage the first letter in the letter stack 22. Vacuum is applied to the suction devices 52 and as the cam 60 continues to rotate, the letter is pulled from the stack and over the weigh scale 70. An appropriate sensor, such as a micro switch, detects the position of the letter over the scale and signals the vacuum pickup mechanism 50 to release the letter thereby dropping it onto the weigh scale 70. The horizontal and vertical plates 40 and 44, respectively, are then pivoted back to their "closed" position so as to engage the next letter in the letter stack 22 and repeat the process.

Once the letter is deposited upon the weigh scale, it is accurately weighed and, in a well known manner, the information is processed to assure that particular letter is assigned the exact postage due. Of course, in some instances, such as when the exact weight of the letter is already known, the letter would be automatically sent to the bulk mailing apparatus for further processing and this step would be eliminated. However, if this is not the case, at this particular time, if it is so desired, an appropriate bar code may be imprinted on the face of the letter. Generally, this would be accomplished by an operator who, through the use of a computer console conveniently positioned with respect to the automatic mailing machine 10 and shown in dotted lines in FIG. 1 imputing information pertinent to the specific letter. The print head pressure plate 82 is energized and moves in a direction toward the bar code print head 80 thereby pressing the letter between the two to enable the bar code to be applied to the letter. The bar code print head 80 is coupled electronically to the letter transport wheel 72 by an appropriate shaft encoder (not shown) such that the resolution of the bar code imprinted on the letter is dependent upon the speed at which the letter is moved along its path. In this instance, the bar code print head has a resolution of 50 dots per inch (50 DPI) which matches the speed of the migrating letter. Once this task is accomplished, the bar code pressure plate 82 retracts to its rest position and the letter is then engaged on one side by the letter kicker wheel 74 which forces it into engagement with the letter transport wheel 72 which is being rotated at a specific speed, which as just referenced, matches the speed at which the bar code print head applies the bar code to the letter. After the code is applied, the continued rotation of the transport wheel 72 causes the letter to be ejected from the weigh scale/bar code areas over the transport belts 90 to rest vertically against the plate 94. As best illustrated in FIGS. 1 and 2, a pair of stopper rods 91 may be utilized to catch and stop the letter as it is ejected from the weight scale 70 by way of hooked ends 91. The stopper rods 91 may be mounted to an appropriate fixture 93 which is spring-biased for rotation about its own axis. The stopper rods 91 may also be mounted to fixture 93 so that they themselves may be rotated to move the hooked ends 91 to a position such that the letters are not engaged.

There, dependent upon what step is to take place next, the letter is further processed. If, for example, the letters are to be sent to a bulk mailing machine, such as are available from Ascom Hasler, Pitney Bowes or Friden, the letters are first translated from their vertical position against the plate 94 to a horizontal position over the table 20 and transport belts 90. This is accomplished by activating the motor which drives the transport belts 90 in the direction toward the front edge of the table. Each of the belts includes a raised cog 95 which, upon rotation of the belt, engages the lower edge of the letter thereby causing the letter to fall from its vertical position to a horizontal position over the table 20 and belts 90. Thereafter, the direction of the belts 90 is reversed and the raised cog 95 comes into contact with the bottom edge of the letter forcing it back into engagement against mounts 97 of the hinged support plate 94. As the letter is being registered, motor 100 is energized causing rotation of lead screw 102 and the downward movement of the elongated member 104 and rollers 106 angularly disposed thereon. The letter is captured between rollers 106 and complimenting set of rollers, or ejection wheels, 108 which are mounted to the table 20 between the transport belts 90. The wheels 108 are caused to rotate by means of a motor/pulley system 110, best illustrated in FIG. 3. Similar to the system just described, the letter is pinched between the wheels 108 and rollers 106 and thereby caused to be ejected off the table 20 and into the bulk mailing machine, as shown in FIG. 2.

However, in some instances it may be desirable to move the letter to a predetermined storage space, such as, for example, one designated for specific and unique zip codes. In this instance, the letter once it is positioned horizontally on the table 20 over the transport belts 90 and the rollers 106 are retracted, the motor/pulley system 92 is activated thereby rotating transport belts 90. The letter is engaged by raised cog 95 which moves it to the edge of the table 20 and onto plate 204 of letter pickup assembly 202. In some instances, it may be desirable to provide a pinch roller mechanism 97, as best seen in FIGS. 1 and 2 to ensure that the letter is properly transported from the belts 90 to the pickup assembly 202. The pinch roller mechanism 97, which is rotatable, and may be spring biased, assists in this function by way of its rollers 99 which engage the letter at the end of the belts travel. The motorized tractor belt assembly 206 is rotated from its retracted "up" position by activating solenoid 220 which in turn drives crank and pin mechanism 218 causing belt assembly 206 to engage the letter. Once the letter is pinched against plate 204, transport device 300 is activated. Support plates 308 which are fixed to pulley and belt assembly 302, are in turn driven in the X-direction, as indicated in FIGS. 7 and 8. Simultaneously, motor 312 is energized thereby rotating linear guide rod 310 to which it is connected and causing linear clutch 313 to translate in the desired Y-direction therealong. As letter pickup assembly 202 is coupled to linear clutch 313, it too is translated in the Y-direction.

Accordingly, as best seen in FIG. 7 the letter pickup assembly 202 is driven in the X-and Y-directions until the assembly is positioned exactly in front of a specific storage space located in storage rack 400 based upon information input from a computer operator relative to the particular letter disposed on the assembly 202. Once that position has been achieved, tractor belt assembly 206 is energized causing drive belt 208 to eject the letter in the Z-direction into the desired and correct storage space in storage rack 400. However, in the instance where the particular storage space is full and cannot accept any further mail, a photocell 315 mounted to plate 204 detects this condition and sends a signal to the computer which, in turn stops further operation of the device and advises the operator that a full condition exists. The operator can then clear the particular space and reactivate the apparatus. The letter pickup assembly 202 is then returned to its position against the front edge of table 20, ready to receive and transport the next letter to a storage space which corresponds to its pre-assigned zip code designation.

In a further embodiment of the invention as shown in FIGS. 8 and 9, it may be desirable to have plate 94 and roller wheels 106 supported thereon be pivotally mounted to vertical mounts 95 so as to be rotatable from a first rest position shown in FIG. 8 to a second position shown in FIG. 9 over and above the ejection wheels 108. This is accomplished by simply pivotally mounting plate 94 to the vertical mounts 95 and by providing a simple electric motor (not shown) which when activated rotates plate 94 from the first position to the second position, and back. The roller wheels 106, would, of course, appropriately be mounted so that when they are rotated over the ejection wheels 108 they are essentially in parallel alignment with each other.

In a still further embodiment of the invention, as shown in FIGS. 12–14, a simplified automatic mailing machine 500 generally includes a mail weighing station 512, a letter support platform 538 positioned opposite the weighing station 512 and a transport station 514 disposed so as to receive letters from said weigh station 512 after weighing thereof and to transport same to other pertinent stations for further handling.

A bundle of mail, 509 which may contain letters 22 of varying sizes and shapes, is deposited upon support platform 538 so as to be engaged by the letter support and drive apparatus 540 in much the same manner as set forth in the detailed description of the previous embodiments. However, in this embodiment, the drive apparatus 540 comprising chain and sprocket assembly 542 is positioned directly opposite rather than over weigh station 512. That is, the individual letters 22 comprising mail bundle 509 are situated upon the letter support platform 538 such that they face weigh station 512 and the reciprocating suction devices 524. Upon activation of the letter transport chain and sprocket assembly 542, each letter 22 in mail bundle 509 is advanced to a position directly opposite front plate 528 of housing 516. A photo sensor, such as an on-scale detector 529 (best seen in FIGS. 13 and 14) which projects light and receives reflected light through one of apertures 526, for instance, the center aperture detects that letter 22 is in place. A signal indicating that a letter is ready to be weighed is relayed to appropriate letter transferring devices. As the mechanics of advancing the letters to the front position is quite similar to the embodiment described hereinabove, it will not be described in extensive detail.

Accordingly, each letter 22 of the bundle 509 is advanced to a position on the support table 538 such that it is opposite suction devices 524, and the on-scale detector 529 which detects the position of the letter 22. The suction devices 524 are activated by a signal sent by detector 529 and are then horizontally translated until they are engaged against the face of the first letter 22 of mail bundle 509. Suction is applied to devices 524, as previously described, and letter 22 is picked from the front of mail bundle 509. The travel of suction devices 524 is then reversed by appropriate mechanism until the translated letter 22 is approximately against front plate 528. Suction is then released from devices 524 permitting letter 22 to fall onto pivoting support plate 518 which is coupled to the actual weighing apparatus (not shown). Letter 22 is thereafter weighed. Once the letter weight is recorded, support plate 518 is pivoted from the position shown in FIG. 13 to a second position as shown in FIG. 14. This is accomplished by way of activating solenoid 520 in response to a signal received when the letter weight is recorded which causes spring loaded lever 522 to pivot about axis 523, in turn dropping letter 22 from support plate 518 directly onto belts 533 of the transport pulley and belt mechanism 532. Oversize letters, for which additional postage is required, are detected by a set of photo sensors 545 (of the type which are well know and commercially available) which are positioned in housing 516 such that they emit light through apertures 546 formed in front plate 528. Light reflected back indicates that an oversize letter is in place on the support platform 518. Upon such detection, a penalty is calculated, and the appropriate postage applied to the letter. As previously described, this operation also will be controlled via the use of a computer which computes the weight and size of letter and then calculates the appropriate postage due.

After the above process has transpired, support plate 518 is pivoted from its support position shown in FIGS. 12 and 13 to its retracted position shown in FIG. 14. Letter 22 drops onto pulley and belt mechanism 532 which is activated such that each belt 533 is caused to move in direction "A" shown in FIG. 13 until each belt's raised section 535 engages the edge of letter 22 thereby knocking it flat onto transport belts 533. An envelope detecting sensor, such as photo sensor 537, is disposed in table 534 so as to project a light beam through aperture 547 therein. If a letter 22 is flat above table 534, the light beam projected from sensor 537 will strike the letter and be reflected back thereby indicating such condition to the appropriate control mechanism. However, as transport belts 533 continue to travel in direction "A", letter 22 will also be translated until such time it migrates completely past aperture 547. At that time, the light beam which no longer is being blocked by letter 22 will not be reflected back to photo sensor 537. An appropriate electrical signal responsive to detection of the unreflected light beam is relayed to the pulley and belt mechanism 532 which, in turn, reverses so as to drive belts 533 in the direction indicated by "B" in FIG. 13. Letter 22 is again engaged by raised section 535 and moved into registration against a reference surface positioned in housing 516. The back and forth movement of the pulley and belt mechanism 532 to knock letters 22 flat and to then register them against a reference surface obtained by the belts 533 which are started automatically when solenoid 520 is activated and which are reversed automatically when photo sensor 537 detects letter 22 is significant.

Once letter 22 is properly registered and weighed, tractor belt assembly 530 is pivoted about its mounting axis 531 from its rest position (shown in FIG. 13) to its active position (shown in FIG. 14). Letter 22 is thereby pinched between pinch rollers 536 534 and tractor belt assembly 530 which when activated, ejects letter 22 to a further mail handling station 515, such as postage application, as described more fully hereinabove.

While the invention has been disclosed and described with reference to a limited number of embodiments, it is apparent that other variations and modifications may be made thereto, and therefore it is intended that the following claims cover such variations and modifications without departing from the spirit and scope of the invention.

What is claimed is:

1. Apparatus for automatic processing of individual pieces of mail from a mail bundle consisting of letters of varying sizes and shapes, comprising:

a) a mail transport station for supporting in a vertical position thereon individual pieces of mail comprising a mail bundle and for horizontally transporting said individual pieces of mail to a mail weighing station;

b) a mail weighing station disposed opposite said mail transport station;

c) a support member mounted to said mail weighing station for receiving and weighing said mail pieces, said support member comprising an elongate platform coupled to an activating solenoid by way of a pivoting member and pivotable between a first position for receiving said transferred mail piece and a second position for releasing said mail piece to a further mail processing station such that activation of said solenoid causes said pivoting member to move between said first and second positions thereby releasing said weighed mail piece in a vertical position for further handling;

d) means coupled to said mail weighing station for repetitively engaging, vertically transferring and thereafter depositing individual pieces of mail from said mail bundle onto said support member; and e) a pulley/belt combination mounted to said apparatus such that mail released from said weighing station is deposited substantially perpendicular thereon and activation of said pulley/belt combination translates said mail piece from vertical to horizontal and said mail pieces are thereafter delivered to a further mail handling station.

2. The apparatus as set forth in claim 1 and further including means coupled to said pulley/belt combination for detecting when said mail pieces are horizontal and for reversing the direction of travel of said pulley/belt combination to register said mail piece with respect to a reference surface.

3. The apparatus as set forth in claim 2 wherein said means coupled to said pulley/belt combination for detecting when said mail pieces are horizontal and for reversing the direction of travel of said pulley/belt combination comprises a photo sensor disposed with respect to said pulley/belt combination so as to detect said mail piece being horizontally translated by said pulley/belt combination and to further detect the absence of same and reverse the direction of travel of said pulley/belt combination to thereby register said mail piece.

4. The apparatus as set forth in claim 1 and further including means mounted to said mail weighing station for detecting when a letter deposited from said mail bundle upon said mail receiving and weighing means is oversized and for automatically adjusting the postage to be applied to such letter after weighing thereof.

5. The apparatus as set forth in claim 4 wherein said means for detecting oversize letters comprises a plurality of photo sensors positioned in said mail weighing station such that light emitted therefrom passes unobstructed when letters of acceptable size are positioned on said receiving and weighing means and such light is caused to be reflected back thereto when oversize letters are supported on said receiving and weighing means.

6. The apparatus as set forth in claim 1 wherein said means for transferring said mail pieces to a further mail handling station comprises a tractor belt assembly and a plurality of pinch rollers, said tractor belt assembly being rotatable toward said pinch rollers to thereby engage said mail piece therebetween and said tractor belt assembly being activatable to transfer said mail piece.

* * * * *